US005596792A

United States Patent [19]

Shelton

[11] Patent Number: 5,596,792

[45] Date of Patent: Jan. 28, 1997

[54] LIGHT GUARD ATTACHMENT CLAMP

[75] Inventor: William J. Shelton, Decatur, Ga.

[73] Assignee: L&P Property Management Company, Chicago, Ill.

[21] Appl. No.: 650,873

[22] Filed: May 20, 1996

[51] Int. Cl.[6] ..... A44B 21/00

[52] U.S. Cl. ..... 24/336; 24/338; 248/231.71

[58] Field of Search ..... 24/336, 338; 40/666; 248/226.12, 228.7, 227.4, 226.11, 228.6, 231.71

[56] References Cited

U.S. PATENT DOCUMENTS

| | | | |
|---|---|---|---|
| 344,567 | 6/1886 | Coleman | 24/336 |
| 2,810,173 | 10/1957 | Bearden | 24/338 |
| 3,231,951 | 2/1966 | De Armond . | |
| 3,398,920 | 8/1968 | Haynes . | |
| 4,036,761 | 7/1977 | Rankin . | |
| 4,673,151 | 6/1987 | Relz | 24/336 |
| 5,148,981 | 9/1992 | Lynch, Jr. et al. . | |

*Primary Examiner*—Victor N. Sakran
*Attorney, Agent, or Firm*—Wood, Herron & Evans, P.L.L.

[57] ABSTRACT

A hinge clamp for attaching a wire grid to an edge portion of a sheet metal light fixture comprising a base plate, a short leg plate and a long leg plate. The leg plates extend orthogonally from opposite side edges of the base plate and are disposed in parallel spaced relation to each other. Each of the base plates has an aperture therein adapted to receive a screw to secure the edge portion of the light fixture to the hinge clamp. The long leg plate of the hinge clamp has a planar inner portion and a curved outer portion. The planar inner portion comprises a near section and a middle finger extending outwardly from the near section. The outer curved portion comprises two identically configured outer fingers located on opposite sides of the middle finger. Each outer finger has an arcuate detent formed therein which is adapted to receive an edge wire of a wire grid in a snap-fit connection. An edge wire of the wire grid is entrapped on one side by the detent and on the other side by the middle finger.

9 Claims, 1 Drawing Sheet

LIGHT GUARD ATTACHMENT CLAMP

FIELD OF THE INVENTION

The present invention relates to hinge clamps used to attach a wire grid to an edge portion of a sheet metal light fixture and more particularly to a hinge clamp which may be secured to a wire grid with a snap-fit connection.

DESCRIPTION OF THE PRIOR ART

Light bulbs and fluorescent lamp tubes are typically secured inside dome shaped light fixtures made of sheet metal, the light fixture being attached to the ceiling of a room inside a building. If the light source is a fluorescent tube, the fluorescent tube is typically an elongated cylinder snapped into the light fixture at the ends of the fluorescent tube. The fluorescent tubes extend longitudinally along the light fixture underneath the curved portion of the light fixture.

Many such light bulbs and fluorescent lamps are broken due to collision with foreign objects and dislodgment of the lamps from their fixtures due to vibration from roof fans, machinery, building cranes and the like. Breakage of the bulbs or fluorescent lamps due to a collision with a foreign object or the dislodgment of the bulbs or lamps from the light fixtures in which they rest cause a substantial hazard to people working or passing beneath the light fixtures. The broken lamps further may contaminate equipment or food or beverages being processed below the fixtures. Therefore, many health codes, electrical codes and military standards require a wire grid to be placed underneath the fluorescent lamps to prevent foreign objects from breaking the lamps and to also prevent fluorescent lamps which do become dislodged from their attachments inside the light fixtures to not fall to the floor but rather be caught by the wire grid. A wire grid secured underneath the light fixture is the simplest and easiest way to prevent the bulbs or fluorescent lamps from falling and injuring people or equipment below or from breaking due to foreign objects colliding with the bulbs or lamps.

Because light bulbs and fluorescent lamps have a limited life, they must be replaced when they burn out or start to flicker every couple of months or years depending on the quality of the lamp. Therefore, the wire grid located below the light fixture must be capable of being removed quickly and easily in order for the bulbs or fluorescent lamps to be replaced. One device which has been utilized to attach a wire grid to an edge portion of a light fixture is a hinge clamp which is permanently affixed to the wire grid and secured to the edge portion of a light fixture with a screw. Typically, four of such clamps are cold rolled onto the wire grid at select locations along the sides of the wire grid and used to secure the wire grid beneath the fixture. The plurality of hinge clamps may be easily attached or removed from an edge portion of a light fixture by tightening or loosening a screw which passes through the hinge clamp so as to facilitate the removal and/or replacement of the fluorescent bulbs inside the fixture.

One such type of hinge clamp is disclosed in U.S. Pat. No. 3,398,920. The hinge clamp of this patent comprises a base plate and two leg plates extending from the side edges of the base plate, each leg plate having an aperture therein adapted to receive a threaded screw. The threaded screw is used to secure an edge portion of a light fixture to a wire grid below the light fixture. This particular hinge clamp has a swivel element attached to the long leg of the clamp which is wrapped around an edge wire of a wire grid, permanently affixing the hinge clamp to the wire grid. Wrapping a leg of the hinge clamp around an edge wire of a wire grid ensures that the hinge clamp does not separate from the wire grid and get lost when the wire grid is removed to change fluorescent bulbs inside the fixture. When fluorescent bulbs are to be replaced, the operator simply loosens the threaded screws of the hinge clamps and pulls the wire guard downwardly away from the light fixture.

These types of hinge clamps are beneficial in that they do not separate from the wire grid and are not easily lost or misplaced. However, these types of hinge clamps must be permanently affixed to the wire grid at the factory, an expensive and time consuming process. Such prior art hinge clamps are cold-rolled onto an edge wire of a wire grid at the factory and cannot be easily attached to a light fixture in the field by an operator.

It has been one objective of the present invention to provide an attachment hinge clamp for attaching a wire grid to an edge portion of a sheet metal light fixture which may be easily snapped onto the wire grid and easily secured to the edge portion of a sheet metal light fixture with a screw.

It has been another objection of the present invention to provide a lightweight metal clamp which may be quickly snapped onto a wire grid by an operator in the field when attaching a wire grid to an edge portion of a sheet metal light fixture.

It has been another objective of the present invention to provide a metal clamp which may be used to attach an edge portion of a light fixture to a wire grid covering the light fixture without permanently affixing the metal clamp to the wire grid.

SUMMARY OF THE INVENTION

The hinge clamp of the present application which accomplishes these objectives comprises a base plate and two leg plates, at least one of the leg plates having an aperture therein adapted to receive a threaded screw. The two leg plates, one long leg plate and one short leg plate, extend orthogonally from opposite side edges of the base plate and are disposed in spaced parallel relation to one another. The long leg plate has a planar inner portion and a curved outer portion. The planar inner portion comprises a near section proximate the base plate and a middle finger extending away from the near portion and base plate. The middle finger is co-planar with the near section. The outer curved portion of the long leg plate comprises two identically configured outer fingers located on opposite sides of the middle finger, each outer finger extending generally parallel the middle finger of the planar inner portion of the long leg plate. The outer fingers each have an arcuate detent formed therein adapted to receive an edge wire of a wire grid such that the edge wire of the grid is entrapped on one side by the detent and on the other side by the middle finger of the planar inner portion of the long leg plate. Such a configuration enables the edge wire of the wire grid to be snapped quickly and easily into place between the detent and the middle finger.

Both the short and long leg plates have a threaded aperture adapted to receive a threaded screw. The apertures are offset relative to one another rather than aligned. The aperture in the long leg plate is proximate the base plate and the aperture in the short leg plate is proximate the end edge of the short leg plate away from the base plate. Both leg plates are embossed on the inner surface thereof in an area surrounding the aperture in the leg plate. The embossed areas aid in securing an edge portion of a sheet metal light fixture to the hinge clamp of the present invention with the aid of a threaded screw. The hinge clamp is typically used with only one screw which may pass through either aperture depending on the configuration of the edge portion of the light fixture.

Utilizing a hinge clamp of the particular configuration described above, a wire grid may be secured underneath a sheet metal light fixture quickly and economically without the hinge clamps having to be permanently affixed to the wire grid. The operator in the field may quickly snap in the wire grid between the middle finger of the planar inner portion and the detent of the curved outer portion of the long leg plate either before or after securing an edge portion of a sheet metal light fixture to the hinge clamp with a screw.

These and other objects and advantages of this invention will become more readily apparent from the following description of the drawings in which:

DESCRIPTION OF THE PREFERRED EMBODIMENT

Figure 1:
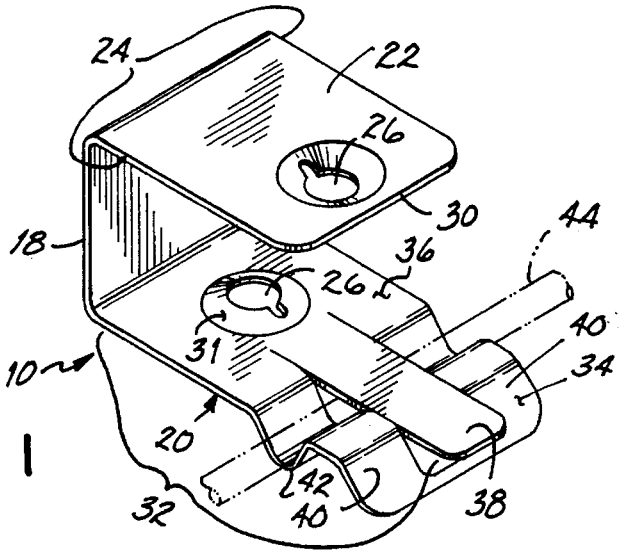
FIG. 1 is a perspective view of the hinge clamp of the present invention.
Figure 4:
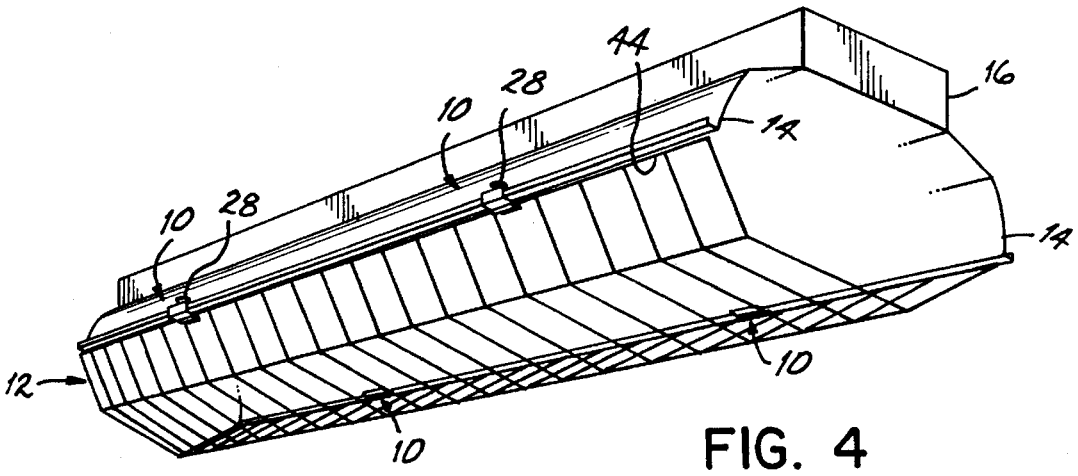
FIG. 4 is a perspective view of a sheet metal light fixture and a wire grid secured to the light fixture with four hinge clamps of the present invention.

Referring to the drawings and particularly to FIG. 1, the hinge clamp 10 of the present invention is illustrated in detail. As illustrated in FIG. 4, the hinge clamps are used to attach a wire grid 12 to an edge portion 14 of a sheet metal light fixture 16. The light fixture 16 is usually attached to the ceiling of a room and is often shaped in an inverted "U" having one or more lamps (not shown) inside the fixture 16. The wire grid 12 covering the fixture 16 prevents foreign objects from breaking the lamps (not shown) located inside the sheet metal light fixture 16. The wire grid 12 also prevents the lamps from falling to the floor and breaking if dislodged from their securement inside the fixture.

Due to the limited life of light bulbs or fluorescent lamps inside the fixture, the bulbs or lamps must be replaced every few months. Therefore, the wire grid 12 must be able to be removed quickly and efficiently. The hinge clamps 10 of the present invention provide a quick, efficient way to secure the wire grid 12 to the sheet metal light fixture 16 and may be used by an operator in the field without having to affix the clamps to the wire grid 12 at the factory where the wire grids are made. Although FIG. 4 illustrates four hinge clamps 10 securing the wire grid 12 to the light fixture 16, any number of clamps 10 may be used as long as the wire grid 12 is securely fastened to the light fixture 16.

Turning to FIG. 1, there is illustrated in detail the hinge clamp 10 of the present invention, The hinge clamp 10 comprises a base plate 18, a long leg plate 20 and a short leg plate 22. The short and long leg plates 18, 20 extend orthogonally from opposite side edges 24 of the base plate 18 and are disposed in spaced parallel relation to each other. Both the short and long leg plates have an aperture 26 therein which is threaded and adapted to receive a threaded screw 28. The aperture 26 in the short leg plate 22 is proximate the end edge 30 away from the base plate 18 whereas the aperture 26 of the long leg plate 20 is proximate the base plate 18. The apertures of the short and long base plates are offset relative to one another so that a screw 28 passing through one of the apertures 26 does not pass through the aperture in the opposing leg plate, but rather presses the edge portion 14 of the light fixture 16 against the opposing leg plate of the hinge clamp 10.

Both leg plates 20, 22 are embossed on the inner surface thereof in an area 31 surrounding the aperture 26 in the leg plate. The embossed areas 31 aid in guiding a screw 28 into the aperture 26 and may aid in securing an edge portion of a sheet metal light fixture to the hinge clamp 10 of the present invention.

The long leg plate 20 of the hinge clamp 10 is divided into a planar inner portion 32 and a curved outer portion 34. The planar inner portion comprises a near section 36 proximate the base plate 18 and a middle finger 38 which extends from the near section 36 of the planar inner portion 32 outwardly therefrom and is co-planar with the near section 36. The outer curved portion 34 of the long leg plate 20 has two identically configured outer fingers 40 which are located on opposite sides of the middle finger 38 and extend generally parallel to the middle finger 38. Each outer finger 40 has an arcuate detent 42 formed therein. The detent 42 is adapted to receive an edge wire 44 of a wire grid 12 such that the edge wire 44 is snapped into place between the detent 42 of the outer fingers 40 and the middle finger 38 of the planar inner portion 32 of the long leg plate 20. The edge wire 44 is entrapped between the detent 42 and the middle finger 38 and thereby secured in place affixing the wire grid 12 to the hinge clamp 10. The edge portion 14 of the light fixture 16 is secured to the hinge clamp 10 with the use of the screw 28.

Figure 2:
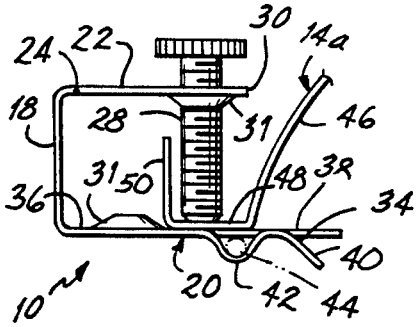
FIG. 2 is a side elevational view of the hinge clamp of FIG. 1 utilizing a threaded screw to secure a particular configuration of an edge portion of a sheet metal light fixture to a wire grid beneath the fixture.
Figure 3:
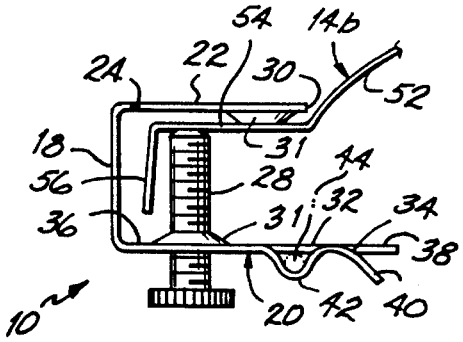
FIG. 3 is a side elevational view of the hinge clamp of FIG. 1 utilizing a threaded screw to secure a different configuration of an edge portion of a sheet metal light fixture to a wire grid beneath the fixture.

As illustrated in FIGS. 2 and 3, the hinge clamp 10 of the present invention is adapted to receive differently configured edge portions **14*a* and 14*b* of sheet metal light fixture 16, an economical and desirable feature of any hinge clamp used to secure wire grids to light fixtures. FIG. 2 illustrates a commonly used edge portion 14*a* of a light fixture 16 having a curved inner portion 46, a relatively short horizontal middle portion 48 and a vertical end portion 50. The vertical end portion 50 is placed on the inside of a screw 28, the relatively short horizontal middle portion 48 being underneath the end of the screw 28 and the curved inner portion 46 of the fixture 16 located inside the screw 28. The screw 28 passes through the aperture 26 in the short leg plate 22 downward through the space between the leg plates and as the screw 28 is tightened the end of the screw 28 pushes the relatively short horizontal middle portion 48 of the edge portion 14*a* of the light fixture 16 against the inner surface of the long leg plate 20, thus securing the hinge clamp 10 to the edge portion 14*a* of the light fixture 16. The edge wire 44 of the wire grid 12 is then clipped between the middle finger 38 of the planar inner portion 32 of the long leg plate 20 and the detent 42 in the curved outer portion 34 of the long leg plate 20. The edge wire 44 of the wire grid 12 may be snapped into and out of the engagement with the long leg plate 20 of the hinge clamp 10 by an operator in the field quickly and easily without having to unscrew the screws 28 and separate the hinge clamps 10 from the edge portion 14*a* of the light fixture 16**.

FIG. 3 illustrates the use of the hinge clamp 10 of the present invention to secure a differently configured edge portion 14*b* of a light fixture 16 to a wire grid 12. Another commonly used edge portion 14*b* of the light fixture 16 comprises a curved inner portion 52, a horizontal middle portion 54 and a vertical end portion 56. The horizontal middle portion 54 of this configuration of the edge portion 14 of the fixture 16 is longer than the horizontal portion 48 of the light fixture of FIG. 2. In this particular use of the hinge clamp 10 the screw 28 is passed upwardly through the aperture 26 in the long leg plate 20. The vertical end portion 56 of the fixture 16 is outside the screw 28 and as the screw is tightened the end of the screw 28 presses the horizontal middle portion 54 of the fixture against the embossed area of the short leg plate 22. The long leg plate 20 is below the short leg plate 22 and an edge wire 44 of the wire grid 12 sandwiched between the middle finger 38 and the detent 42 of the outer fingers 40 of long leg plate 22 of the hinge clamp 10. With the use of one screw 28, the hinge clamp 10 of the present invention may be used to secure many different configurations of light fixtures to a wire grid covering and protecting one or more fluorescent lamps inside the fixture.

Although we have shown and described only two configurations of fixtures which my be utilized with the present invention, those skilled in the art will readily recognize that many different configurations of light fixtures may be used with the present invention.

While we have described only one configuration of hinge clamp to be used with these different light fixtures, those skilled in the art will recognize modifications or changes which may be made to the hinge clamp without departing from spirit or scope of the invention. Accordingly we intend for our invention to be limited only by the scope of the following claims.

What is claimed is:

1. A hinge clamp for attaching a wire grid to an edge portion of a sheet metal light fixture which clamp comprises:

a base plate, a short leg plate and a long leg plate extending orthogonally from opposite side edges of said base plate and disposed in spaced parallel relation to each other, an aperture in at least one of said leg plates, said long leg plate having a planar inner portion and a curved outer portion, said planar inner portion comprising a near section proximate said base plate and a middle finger extending from said planer inner portion of said long leg plate, said middle finger being coplaner with said near section, said outer curved portion comprising two identically configured outer fingers located on opposite sides of said middle finger and extending generally parallel to said middle finger, said outer fingers each having an arcuate detent formed therein, which detent is adapted to receive a wire of said wire grid such that said wire is entrapped on one side by said detents and on the other side by said middle finger.

2. The hinge clamp of claim 1 wherein both said short leg plate and said long leg plate have an aperture therein.

3. The hinge clamp of claim 2 wherein each of said leg plates is embossed on the inner surface thereof in an area surrounding said aperture.

4. The hinge clamp of claim 1 wherein said curved portion has an arcuate rail holder for holding a rail of a wire guard of a light fixture.

5. The hinge clamp of claim 1 wherein said aperture is internally threaded.

6. The hinge clamp of claim 1 wherein said aperture is adapted to receive a threaded screw.

7. The hinge clamp of claim 6 further comprising a screw threaded through said aperture.

8. A hinge clamp for attaching a wire grid to an edge portion of a sheet metal light fixture which clamp comprises:

a base plate, a short leg plate and a long leg plate extending orthogonally from opposite side edges of said base plate and disposed in spaced parallel relation to each other, an aperture in at least one of said leg plates, said long leg plate having an inner portion and an outer portion, said inner portion comprising a planar near section proximate said base plate and a middle finger extending from said planer inner portion of said long leg plate, said middle finger being generally co-planer with said planar near section, said outer portion comprising two identically configured outer fingers located on opposite sides of said middle finger and extending generally parallel to said middle finger, at least one of fingers having an arcuate detent formed therein, which detent is adapted to receive a wire of said wire grid such that said wire is entrapped in said detent on one side by said outer fingers and on the other side by said middle finger.

9. The hinge clamp of claim 1 wherein both said short leg plate and said long leg plate have an aperture therein.

* * * * *